US005305953A

United States Patent [19]

Rayburn et al.

[11] Patent Number: 5,305,953

[45] Date of Patent: Apr. 26, 1994

[54] REACTIVE HEATING CONTROL SYSTEM

[75] Inventors: Ronald R. Rayburn, Huntington; Harold L. Jeffery, Ft. Wayne, both of Ind.

[73] Assignee: Carrier Corporation, Syracuse, N.Y.

[21] Appl. No.: 83,575

[22] Filed: Jun. 30, 1993

[51] Int. Cl.[5] ..... F24F 13/10

[52] U.S. Cl. ..... 236/49.3; 165/22

[58] Field of Search ..... 62/186; 165/22; 236/49.3

[56] References Cited

U.S. PATENT DOCUMENTS

| | | | |
|---|---|---|---|
| 3,788,386 | 1/1974 | Demaray | 165/22 X |
| 4,272,966 | 6/1981 | Niemann et al. | 236/49.3 X |
| 4,406,397 | 9/1983 | Kamata et al. | 236/49.3 X |
| 4,716,957 | 1/1988 | Thompson et al. | 236/49.3 X |
| 4,754,919 | 7/1988 | Otsuka et al. | 165/22 X |
| 4,830,095 | 5/1989 | Friend | 236/49.3 X |
| 4,928,750 | 5/1990 | Nurczyk | 165/22 X |
| 5,025,638 | 6/1991 | Yamagishi et al. | 236/49.3 X |
| 5,076,346 | 12/1991 | Otsuka | 236/49.3 X |

*Primary Examiner*—William E. Tapolcai

[57] ABSTRACT

Method and apparatus are disclosed for responding to an unpermissible rise in the supply air temperature in any zone of a variable air volume system. A warning is generated to a controller in each zone which adjusts the air flow to the zone within predetermined limits. Different adjustment occur depending on whether the temperature of the space being heated is below the zone setpoint or above the zone setpoint.

26 Claims, 7 Drawing Sheets

REACTIVE HEATING CONTROL SYSTEM

FIELD OF INVENTION

This invention relates to the control of dampers in a variable air volume system wherein each damper defines the volume of heated air being made available to a zone to be heated. In particular, this invention relates to the control of dampers when the air being supplied to the dampers rises above a permissible level.

Variable air volume (VAV) systems are widely used to supply heated air from a central source to different zones of a home or office building. The typical VAV system furnishes a variable volume of air to a particular zone depending on that zone's needs as measured by a thermostat sensing the temperature of the space or zone to be heated. The volume of air to be provided is controlled by at least one damper in a duct supplying the heated air to the zone. The damper is positioned within the duct in response to the measured needs of the zone. In this regard, when the temperature of the space deviates from a predetermined set point, the damper is moved to a more open position so as to allow a greater volume of heated air to flow into the zoned space. Conversely, as the temperature of the space approaches the setpoint, the damper is moved to a more closed position so as to decrease the volume of heated air flowing into the space.

There may be times when most of the dampers in a multiple zoned system have moved to a closed position as setpoints in their respective zones have been achieved. The remaining zones may suddenly be receiving large amounts of hot air previously going to the closed damper zones. This problem is normally solved by bleeding off some of the hot air going to the zones in a bypass configuration. This in turn leads to the recycling of hotter than normal air through the heat exchanger that may cause an overheating of the heat exchanger unit. There is a need under such circumstances to provide as much relief as possible to the heat exchanger unit.

There may be other conditions occurring in the VAV system that would lead to the aforementioned overheating. In each case, there is a need to provide as much relief as possible.

OBJECTS OF THE INVENTION

It is an object of the invention to provide a VAV system with relief when the supply of heated air to the zones undergoes a significant change in temperature.

It is another object of the invention to provide a reactive control in a VAV system which reacts to a significant change in temperature of the supplied air to the zones.

SUMMARY OF THE INVENTION

The above and other objects of the invention are achieved by monitoring the condition of the supplied air in a plurality of zones and sensing when a supply air temperature in any zone exceeds a certain undesirable threshold. When this occurs, a monitor sends a warning flag to each zone control within the VAV system. Each local zone control proceeds to compare its local space temperature with its local setpoint temperature. If the local space temperature is below local setpoint, the local zone control will incrementally add one damper position to the currently commanded damper position. The commanded increment will be followed by a timely inquiry as to whether the warning flag is still in effect. If so, the local zone control will incrementally add another damper position. The local zone control will continue to add damper positions until the monitor stops sending the warning flag, or the zoning stage has added a predefined number of incremental damper positions or the local space temperature rises above local setpoint temperature. In this latter case, the local zone control proceeds to inquire as to whether the rise above local setpoint is less than one degree. If the rise is one degree or less, the local zone control will immediately add damper positions corresponding to the amount by which the rise is above setpoint. The local zone control will thereafter hold to the established position until the local space temperature rises more than one degree above setpoint. In this case, the local zone control will immediately delete the added positions.

It is to be noted that each local zone control operates completely independent of other zone controls when responding to the monitor's warning. In this manner, each local zone control contributes to the relief of the monitor's detected supply air condition on the basis of that local zone's particular temperature situation. The above is accomplished by a series of communication protocols between the local zone control and the monitor which allows the flag warning to be received and selectively processed by each local zone control. The selective processing includes an ability by each local zone control to process every other warning communication from the monitor.

BRIEF DESCRIPTION OF THE DRAWINGS

Other objects and advantages of the present invention will be apparent from the following description in conjunction with the accompanying drawings in which.

DESCRIPTION OF THE PREFERRED EMBODIMENT

Figure 1:
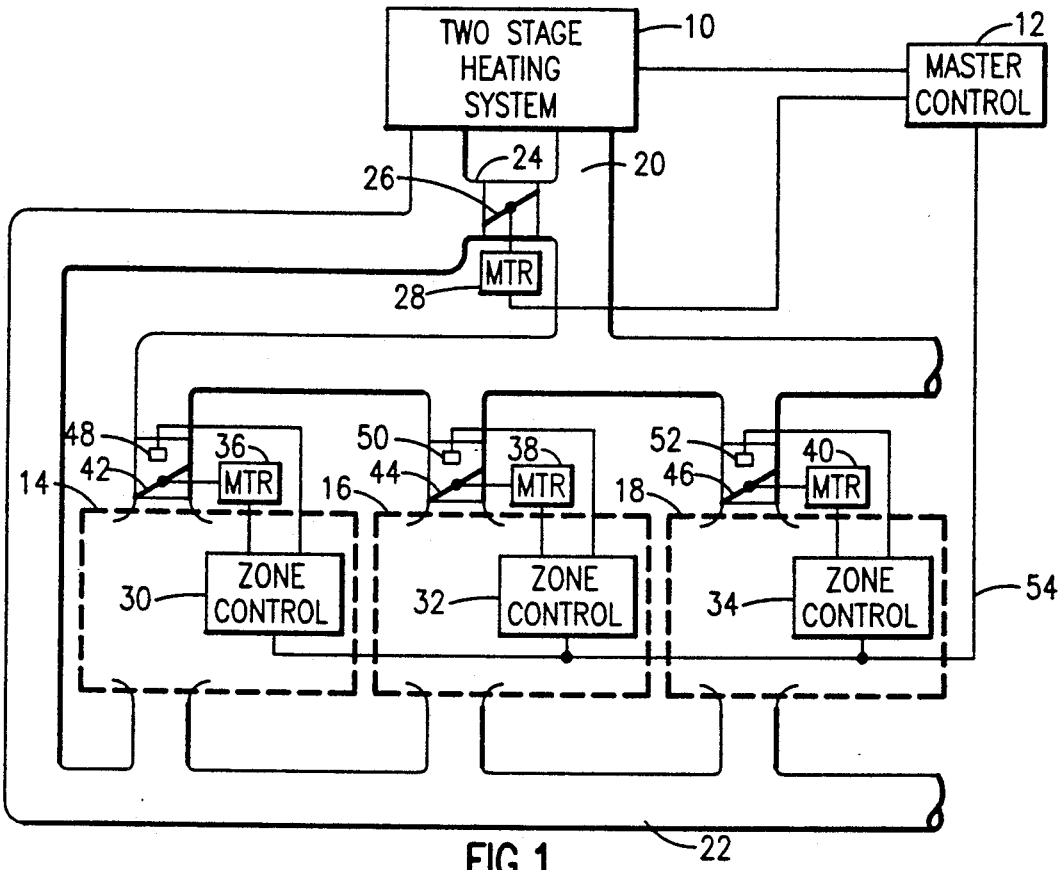
FIG. 1 is an overall diagram of a VAV system including a master control and local zone controls of individual dampers associated with respective zones.

Referring to FIG. 1, a two stage heating system 10 under the control of a master control 12 provides heated air to a plurality of zones 14, 16 and 18 via an air supply duct 20. The air in the zones is returned to the two stage heating system 10 for further heating via the air return duct 22. The air supply duct 22 and the air return duct 24 may have more than the three zones depicted as indicated by the breakline for each duct.

A bypass duct 24 including a bypass damper 26 and associated motor 28 allows air in the air supply duct to be selectively returned to the two stage heating system 10. The selective return is dictated by the main control 12 operating the motor 28 so as to open or close the bypass damper 26.

Each of the zones 14, 16 and 18 is seen to include a zone control 30, 32, or 34 which controls a motor 36, 38 or 40 that positions a zone damper 42, 44 or 46 within a branch duct associated with the air supply duct 20. The damper positioning is normally a function of the difference in the sensed temperature in each zone and a setpoint temperature for the zone. Each zone control also receives a sensed supply air temperature in the respective branch duct as measured by a supply air sensor 48, 50 or 52. As will be explained in detail hereinafter, these sensed supply air temperatures are made available to the main control 12 via a communication bus 54. Further communication also occurs between the master control 12 and the respective zone controls when any of these sensed supply air temperatures exceed a predetermined level evidencing a condition needing correction. As has been previously noted, one such condition occurs when the bypass duct 24 is opened and heated air is returned to the heating system 10 due to a change in demand for supply air to the zones. In this instance the supply air temperatures may increase prompting the need for corrective action.

Figure 2:
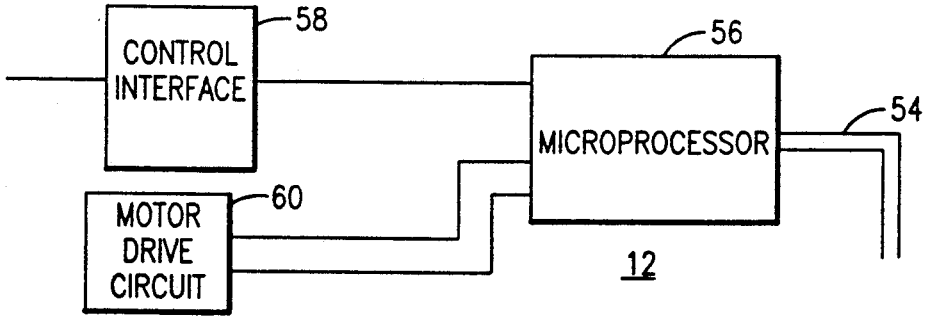
FIG. 2 is a diagram of the microprocessor configuration within the master control.

Referring to FIG. 2 the main control 12 is seen to include a programmed microprocessor 56 having a control interface 58 to the two stage heating system 10 of FIG. 1. The control interface 58 may be a relay control or other well known interface that selectively activates stages of heating in the heating system in response to control signals from the microprocessor 56. The microprocessor 56 furthermore generates a control signal to a motor drive circuit 60 associated with the bypass duct motor 28 of FIG. 1. Finally the microprocessor 56 sends and receives information to and from the zone controls 30, 32 and 34 of FIG. 1 via the communication bus 54.

Figure 3:
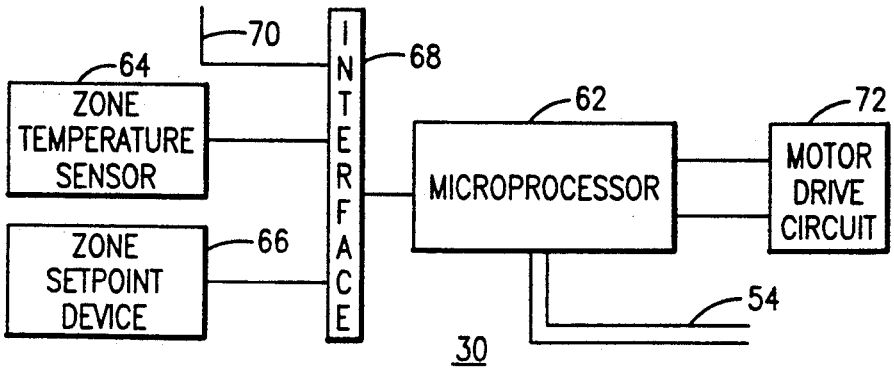
FIG. 3 is a diagram of the microprocessor configuration within one of the zone controls.

Referring to FIG. 3, the zone control 30 is seen to include a programmed microprocessor 62 which receives and transmits information over the bus 54 to the microprocessor 56 within the master control 12. The microprocessor is furthermore connected to a zone temperature sensor 64 and a zone setpoint device 66 via an analog/digital interface 68. It is to be appreciated that temperature values defined by the sensor 64 and setpoint device 66 are periodically read and stored for use by the microprocessor 62. The microprocessor 62 also periodically stores the supply air temperature read over the line 70 that is connected to the air sensor 48 in FIG. 1. In addition to the reading and storing of information, the microprocessor also controls the motor 36 through issuing control signals to a motor drive circuit 72. The motor 36 is preferably a stepper motor which receives predefined numbers of pulses from the motor drive circuit 72 defining a desired incremental movement of the motor 36 and the damper 42 associated therewith. The position of the motor and the damper 42 can always be tracked by first of all driving the motor to a home position corresponding to a closed damper position and thereafter defining additive incremental movements from the home position by digital commands from the microprocessor 62.

It is to be appreciated that the zone control of FIG. 3 is similarly duplicated in the zone controls 32 and 34 of FIG. 1. In this regard, each zone control includes a programmed microprocessor for reading and storing information and communicating with the microprocessor 56 via the bus 54. Each zone control furthermore includes a motor drive circuit under control of the programmed microprocessor for commanding various positions of the motor and associated damper in the local zone.

Figures 4, 4A:
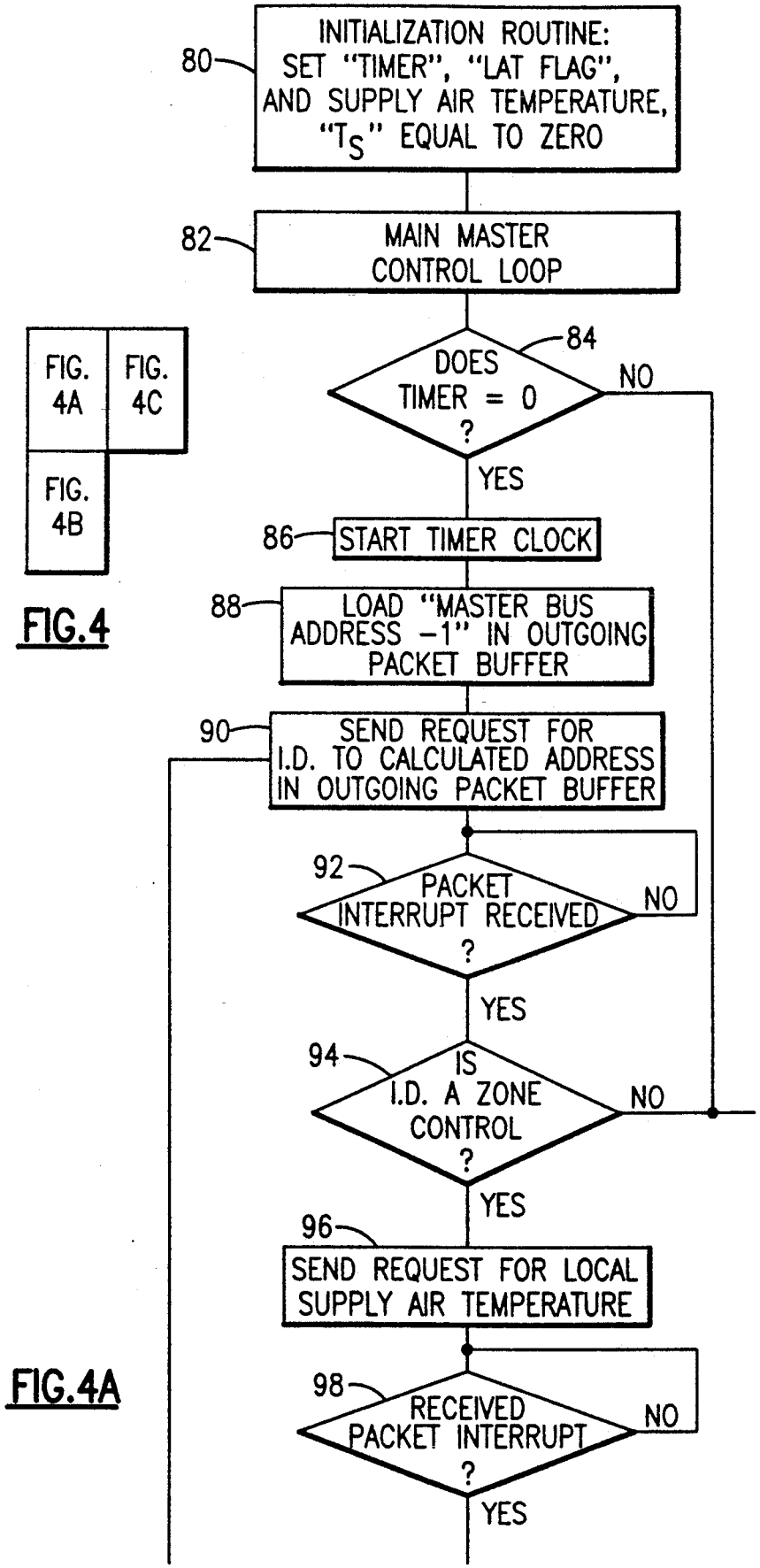
FIGS. 4A–4C comprise a flow chart of a software program residing in the microprocessor of FIG. 2 which ascertains the highest supply temperature in the zones and transmits appropriate signals to the zone controls.

Referring to FIG. 4A, the beginning of the program residing in the microprocessor 56 of the master control 12 is illustrated in detail. The program begins with an initialization routine in a step 80 which occurs when the microprocessor 56 is first switched on. The initialization routine includes setting the following program variables equal to zero: "TIMER," "LAT Flag," and supply air temperature, "$T_S$." The term LAT is "LAT Flag" is an abbreviation for "leaving air temperature" which is generally considered to be the temperature of the air leaving the two stage heating system 10. Following the initialization routine, the microprocessor 56 proceeds to a main master control loop in a step 82. The main master control loop determines when the microprocessor 56 is to execute a given program that has been stored for execution in the microprocessor. At the appropriate time within the main master control loop, the program which will hereinafter be described is invoked. At this time, the microprocessor will proceed to a step 84 and inquire as to whether TIMER is equal to zero. Since the timer variable is initially set equal to zero in step 80, the microprocessor will proceed to a step 86 and start a timer clock. The timer clock will begin to count down from a predetermined clock value. This value will depend on the particular variable air volume system in which the master control is to operate. In this regard, a sufficient amount of time must elapse for each local zone control in the variable air volume system to at least begin to react to any previous commands by the master control. This will of course depend on the number of zone controls in the system that must respond. For a system including sixty four zone controls, an arbitrary clock value of ten seconds was selected for the timer clock of step 86.

Upon starting the timer clock, the microprocessor proceeds to a step 88 and loads the "master bus address minus one" into the outgoing packet buffer associated with the communication bus 54. In the preferred embodiment, the zone controls 30 through 34 will have successively lower addresses from that of the master control 12. In this regard, the first zone control 30 will have an address one lower than the master control address. The microprocessor will proceed to a step 90 and send a request for the identification of the entity addressed by the computed address of step 88. The microprocessor will thereafter await a packet interrupt signal in a step 92. When a packet interrupt is received, the microprocessor will inquire in a step 94 as to whether the identification (ID) that has been received identifies one of the zone controls 30 through 34. If the answer is yes, the microprocessor will proceed to a step 96 and send a request for the local supply air temperature from the identified zone control. The microprocessor 56 will thereafter look for a received packet interrupt in a step 98. When a packet interrupt is received, it will be interpreted to be the local supply air temperature for the particular addressed zone control. This local supply air temperature value is stored as the variable "$T_L$" in a step 100. The microprocessor will next proceed in a step 102 to send the "LAT Flag" value to the addressed zone control. It will be remembered that this value is initially zero in a step 80. The program will now proceed to decrement the address that has been stored in the outgoing packet buffer of the microprocessor 56. This will effectively allow for the addressing of the next zone control that is to be queried. Before making the next inquiry, the microprocessor proceeds to a step 106 and inquires as to whether the supply air temperature "$T_s$" is equal to zero in a step 106. Since this variable is initially equal to zero, the microprocessor will proceed to a step 108 and set the supply air temperature "$T_s$" equal to the stored local supply temperature "$T_s$."

The microprocessor will exit from step 108 and return to step 90 wherein a request for the identification of the entity addressed by the decremented address of step 104 will occur. Upon receiving the identification from the thus addressed entity, the microprocessor will inquire in step 94 as to whether the thus addressed entity is a zone control. In the event that anther zone control has been addressed, the microprocessor will proceed to request the supply temperature and store the same in the variable "$T_L$" in step 100. Since the "LAT Flag" value is still equal to zero, the microprocessor will send this particular value to the thus addressed zone control in step 102. The addressing in the outgoing packet buffer will again be decremented in a step 104 before inquiry is again made as to whether "$T_s$" is equal to zero in step 106. "$T_s$" will no longer be zero since it will have been set equal to the local supply temperature of the previously addressed zone control. The microprocessor will hence proceed along the "no" path from step 106 to a step 110 and inquire as to whether the supply air temperature "$T_s$" is less than the currently stored local supply temperature, "$T_L$." If the previously stored supply air temperature "$T_s$" is less than the currently stored local air supply air temperature than the microprocessor will proceed to set "$T_s$" equal to the currently stored local supply temperature, "$T_L$."

Referring to both steps 110 and 112, the microprocessor will either proceed out of step 110 to step 90 in the event that "$T_s$" is greater than "$T_L$" or it will return to step 90 after setting "$T_s$" equal to "$T_L$" in step 112. In either event, the microprocessor will again send a request for the identification of the entity whose address has been computed in step 104. Upon receiving the packet interrupt signal in step 92 the identification of the addressed entity will be examined in a step 94. As long as the identification continues to be that of a zone control, steps 96 through 108 will be repeated. Inquiry will ultimately be made in each instance in step 110 as to whether the currently stored supply air temperature "$T_s$" is less than the local supply air temperature of the particularly addressed local zone control. If yes the currently stored supply air temperature "$T_s$" is set equal to the local supply air temperature of the currently addressed zone. In this manner, when the last addressed zone control has been queried, the supply air temperature "$T_s$" will be equal to the highest local supply air temperature found in all of the queried zone controls.

Figure 4B:
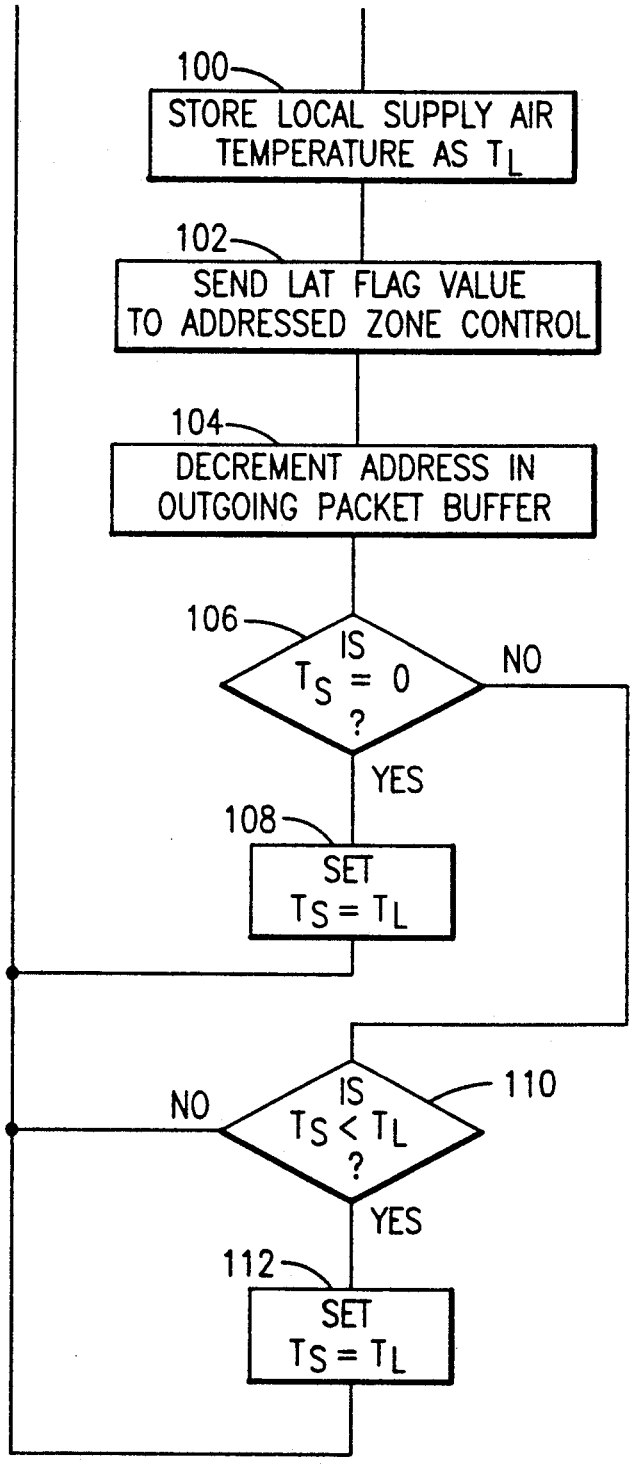
Figure 4C:
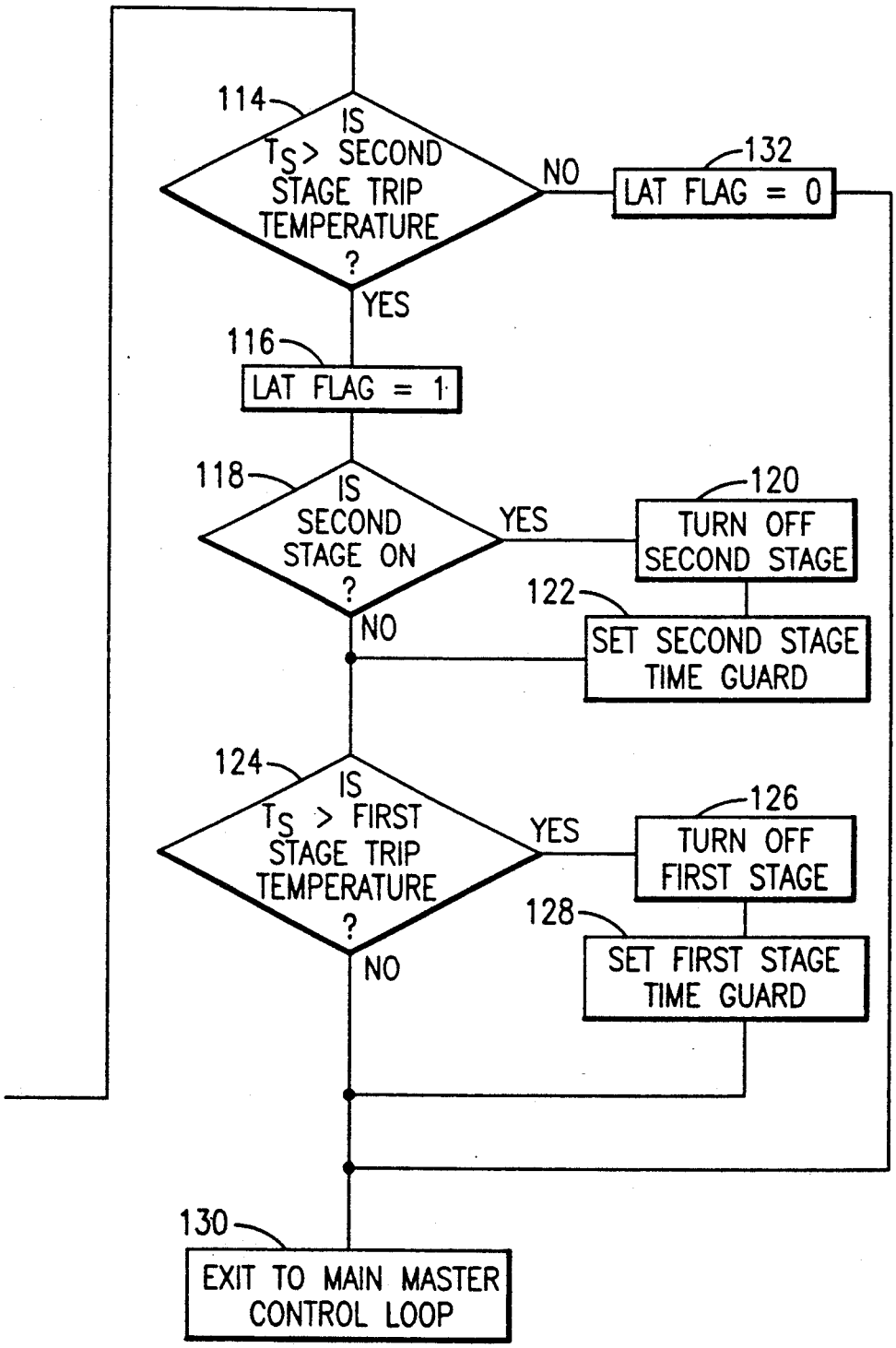

Referring to step 94, when an ID is encountered that does not correspond to a zone control, the microprocessor will proceed to a Master LAT Flag routine in FIG. 4C. This will occur when the last zone control has been encountered and appropriately queried as discussed above.

Referring to the Master LAT Flag routine in FIG. 4C, it is seen that this routine begins with an inquiry in a step 114 as to whether "$T_s$" is greater than the value of a second stage trip temperature. It will be remembered that the heating system 10 of FIG. 1 has two stages of heating. Each stage of heating will have a particular trip temperature dictating when the particular stage is to be deactivated. This particular value is stored as the second stage trip temperature for use by the microprocessor 56 in step 114. In the event that the highest local supply air temperature in the zone controls 30–34 is greater than this second stage trip temperature, the microprocessor proceeds to a step 116 and sets the "LAT Flag" equal to one. As has been previously noted, the term LAT in LAT Flag is an abbreviation for leaving air temperature. The leaving air temperature generally being referred to is the temperature of the air leaving the two stage heating system 10. The microprocessor next proceeds in a step 118 to inquire as to whether the second stage is on. In the event that it is, the second stage is deactivated in a step 120 and a time guard is activated in a step 122 The time guard is a safety feature which will not allow the second stage to be reactivated until a particular period of time has elapsed. Upon setting the time guard for the second stage, the microprocessor proceeds to a step 124 and inquires as to whether the supply air temperature "$T_s$" is also greater than the first stage trip temperature. It is to be noted that the first stage trip temperature is higher than the second stage trip temperature and is unlikely to be exceeded by "$T_s$" at the same time that the lower trip temperature is encountered. In this regard the first stage temperature is more likely to be exceeded on subsequent executions of step 124. When "$T_s$" does rise above the second stage trip temperature, the microprocessor proceeds to a step 126 and turns the first stage off. The microprocessor will also set the first stage time guard in a step 128 before exiting to the main control loop in a step 130. Referring to step 124 in the event that the supply air temperature "$T_s$" is not greater than the first stage trip temperature, than the microprocessor immediately proceeds to exit to the main control loop in step 130. Referring again to step 114, in the event that the supply air temperature, "$T_s$," is not above the second stage trip temperature, the microprocessor will immediately proceed to a step 132 and set the LAT Flag equal to zero before exiting to the main control loop in step 130.

It is hence to be appreciated that the microprocessor 56 will have either set the LAT Flag equal to zero in step 132 or set the LAT Flag equal to one in a step 116 before exiting to the Main Loop Control in step 130. This LAT Flag value will be subsequently sent to each zone control when the Main Loop Control returns to the program of FIGS. 4A and 4B and step 102 is successively implemented a number of times. In this regard, step 102 causes the LAT Flag value to be sent to each addressed zone control wherein the zone addresses are successively defined in step 104. In this manner, all zone controls will have been alerted when the supply air temperature in any zone falls below the second stage trip temperature.

Figures 5, 5A:
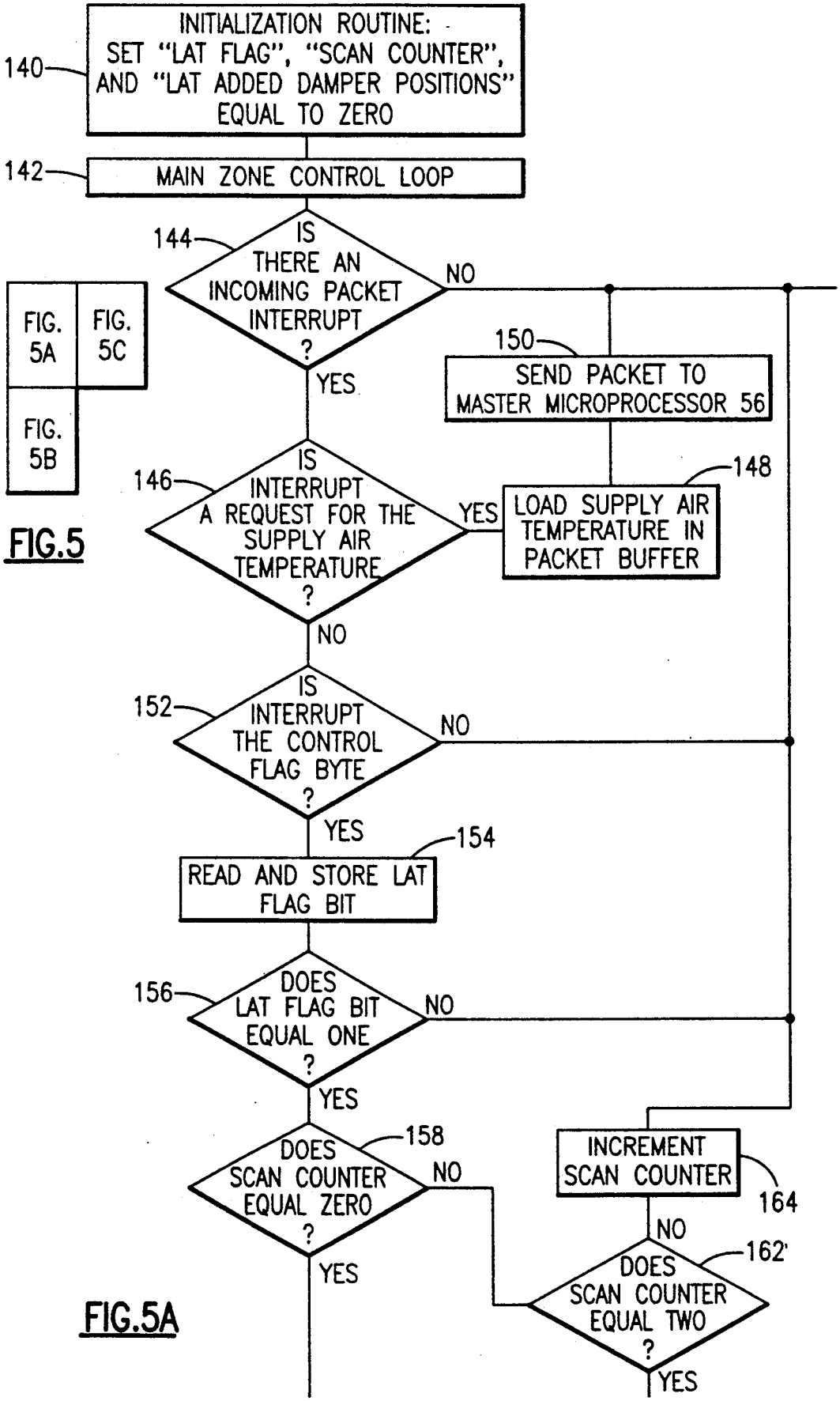
FIGS. 5A–5C comprise a flow chart of a software program residing in each of the zone controls which responds to the various commands issued by the software program of FIGS. 4A–4C so as to provide supply temperatures upon request and to furthermore control the dampers within the respective zones as required.

Referring to FIG. 5A, the zone control software program residing within each of the microprocessors in the zone controls 30, 32, and 34 is illustrated in detail. This software begins with a step 140 wherein an initialization routine is executed each time the microprocessor within a zone control is switched on and powered up. The initialization routine of step 140 includes setting the following variables equal to zero: "LAT Flag," Scan Counter, and "LAT Added Damper Positions." The zone control microprocessor proceeds to a step 142 and begins a main zone control loop. The main zone control loop will include a number of different programs that are to be executed by the zone control microprocessor including by way of example the monitoring of the zone temperature sensor 64, the zone setpoint device 66, and the supply air temperature sensor such as 48 for the microprocessor 62. As a result of this monitoring, the zone control microprocessors will always have present values of these parameters stored for use. Other examples of programs that are executed in a sequence by the main zone control loop would be the motor command program which would issue commands to the respective motor drive circuit such as 72 in response to any computed change in the motor command by the software of FIGS. 5A, 5B, and 5C. This computed change would be reflected in the upper half of possibly commanded motor positions which is reserved exclusively for the software of FIGS. 5A, 5B, and 5C.

When the main zone control loop reaches a point within its loop for execution of a "leaving air temperature" program, it exits to a step 144 and inquires as to whether an incoming packet interrupt has occurred. When an interrupt is received, the microprocessor proceeds in a step 146 to note whether the interrupt is a request for the local supply air temperature. In the event that it is a request for supply air temperature, the microprocessor proceeds in a step 148 to load the previously read and stored supply air temperature into its packet buffer. This supply air temperature is subsequently sent to the master microprocessor 56 over the communications bus 54 in a step 150. The microprocessor will thereafter proceed to a checking routine in FIG. 5C which will be described in detail hereinafter.

Referring again to step 146, in the event that the interrupt is not a request for the local supply air temperature, the microprocessor will proceed to a step 152 and inquire as to whether the interrupt is the control flag byte. In the event that the interrupt is the control flag byte, the zone control microprocessor will proceed to a step 154 and read and store the LAT Flag bit portion of this byte. The value of the thus stored LAT Flag bit will be examined in a step 156 for being equal to one. In the event that it is not, the microprocessor will proceed from step 156 along the "no" path and return to the check routine of FIG. 5C. It is to be noted that the same will occur if the control flag byte has not been received in a step 152. Referring again to step 156, in the event that the LAT Flag bit value is one, the microprocessor will proceed to a step 158 and inquire as to whether the "scan counter" is equal to zero. It will be remembered that the "scan counter" is initially set equal to zero which will prompt the zone control microprocessor to proceed to step 160 and increment the "scan counter." The "scan counter" will hence be set equal to one which will indicate that the zone control has thus been queried once by the master control. Referring again to step 158, in the event that the "scan counter" is not equal to zero, the microprocessor will proceed to a step 162 and inquire as to whether the scan counter equals two. Since the scan counter will only equal one on the next time through, the microprocessor will proceed to a step 164 and increment the "scan counter" once again. The microprocessor will proceed to the check routine of FIG. 5C at this point. Referring again to step 162, when the scan counter equals two, the program proceeds to a step 166 and clears the "scan counter" back to zero. It is hence to be appreciated that the "scan counter" will be successively incremented from zero to one in step 160 and then to two by step 164 before again being cleared in step 166. The program proceeds to a step 168 when the "scan counter" is either detected as zero in step 158 or two in step 162.

Referring to step 168, the microprocessor inquires as to whether the local space temperature that has been read and stored from the local zone temperature sensor is greater than the setpoint temperature that has been read and stored from the local zone setpoint device. In the event that the space temperature is less than or equal to the setpoint, the microprocessor will proceed along the "no" path from step 168 to a step 170 and read the value of "LAT Added Damper Positions." The thus read value will be compared to a maximum allowed value of added damper positions in a step 172. The maximum allowed value will be preferably one half of the total potential damper positions that may be commanded by the zone control microprocessor. In other words, if there are thirty possible incremental damper positions between a closed damper position and a completely open damper position, than the maximum value of "LAT Added Damper Positions" will be fifteen. Referring again to step 172, in the event that the value of added damper positions has not exceeded the maximum allowable, the microprocessor will proceed to a step 174 and add one incremental damper position to the present value of the "LAT Added Damper Position." The new "LAT Added Damper Positions" will subsequently be used by the motor command program that is triggered by the main control loop upon exiting thereto in a step 176. In this regard, the motor command program will execute any change in motor position occurring in the upper half of numerical motor positions. This is due to the upper half of numerical motor positions having been set aside as "LAT Added Damper Positions."

It is hence to be appreciated that the "LAT Added Damper Positions" will be used up one at a time to the extent that the space temperature remains above the setpoint temperature. This addition of one damper position will continue to occur until the "LAT Added Damper Positions" equal the maximum. At this point, the microprocessor will without adding any further damper positions exit from step 172 to the main loop control in step 176.

It is to be noted that the above incremental addition of damper positions occurs only when the local space temperature is less than or equal to local setpoint. When a particular zone control microprocessor determines that the local space temperature is greater than the local setpoint, it will proceed from step 168 to a step 178. Referring to step 178, it is seen that the zone control microprocessor adds one degree to the setpoint value. The programmed microprocessor next proceeds to subtract the space temperature from the adjusted setpoint in a step 180. It is to be appreciated that a positive difference will result from step 180 if the space temperature is less than one degree above the original setpoint reading. This positive difference is noted by the microprocessor in step 182. The microprocessor will thereafter proceed to a step 184 and convert the temperature difference calculated in step 180 to a number of incremental damper positions. This conversion is a function of how far the damper is to be moved for a given calculated difference. In the preferred embodiment, each of the fifteen allowed added damper positions correspond to one tenth of a degree temperature difference. In this regard, the temperature difference of step 180 is divided by one tenth of a degree per damper position to arrive at the number of incremental damper positions. The thus determined number of incremental damper positions are loaded into the "LAT Added Damper Positions" storage location in a step 186. This new number of "LAT Added Damper Positions" replaces any previously stored value of "LAT Added Damper Positions." The new value of "LAT Added Damper Positions" value is made available to the motor command program upon exiting to the main loop control in step 176. It is hence to be appreciated that in the event the space temperature in a given zone rises above setpoint by less than one degree, the amount by which the space temperature may be permitted to rise further will be converted to incremental damper positions allowing for an immediate opening of the damper by the motor command program.

Referring again to step 182, in the event that the difference between the set point and the space temperature is more than one degree, than the microprocessor proceeds to a step 188 and clears the "LAT Added Damper Positions" that may have been previously defined as a result of either step 174 or step 184. The microprocessor thereafter proceeds from step 188 to exit to the main loop control in step 176. The main loop will invoke the motor command program which will note the need to change commanded damper position due to the cleared "LAT Added Damper Positions." In this regard, the upper half of possible commanded damper positions will now be at zero. The zone control motor and associated damper will be appropriately repositioned.

Figure 5B:
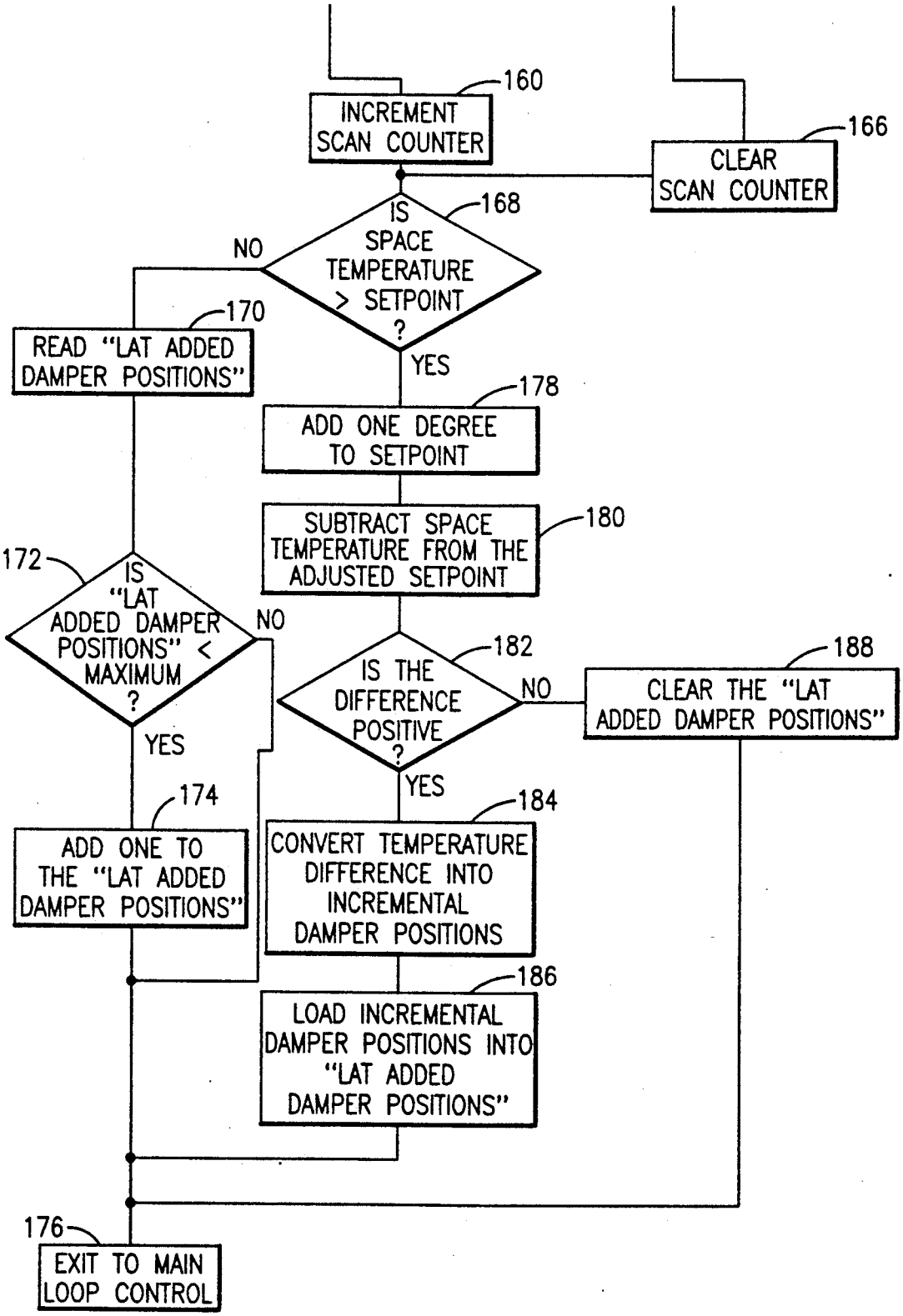

It will be remembered that a check routine is invoked at several points within the software program of FIGS. 5A and 5B. For instance, the check routine may be invoked out of step 144 when the particular zone control software is entered into from the main zone control loop and no packet interrupt has occurred from the master control 12. The check routine might also be invoked if the master control is merely asking for the local supply air temperature in steps 146, 148 and 150. The check routine is also invoked if the interrupt is not the flag control byte in FIG. 152. The check routine is furthermore invoked if the LAT Flag bit value is zero in step 156 or the "scan counter" is one as detected in steps 158 and 162.

Figure 5C:
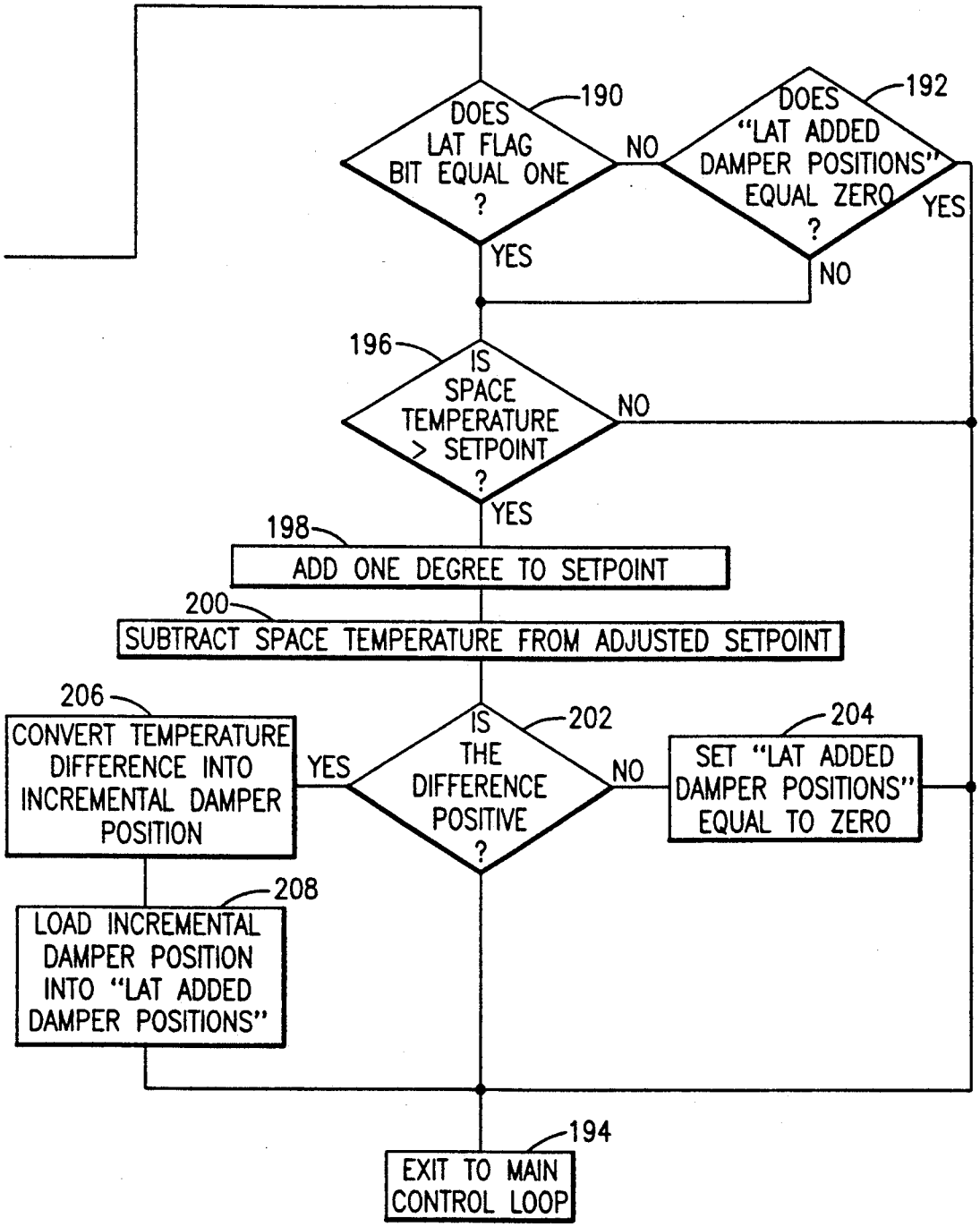

Referring to FIG. 5C, the check routine begins with a step 190 which inquires as to whether the "LAT Flag Bit" equals one. If this bit value is zero, the microprocessor will proceed to a step 192 and inquire as to whether the "LAT Added Damper Positions" is now zero. If yes, the microprocessor will proceed to exit in a step 194 to the main control loop. If on the other hand the "LAT Flag Bit" equals one or the "LAT Added Damper Positions" does not equal zero, the microprocessor will proceed from either step 190 or 192 to a step 196. Referring to step 196, an inquiry is made as to whether the space temperature in the particular zone is greater than the setpoint for that zone. If the answer is no, than the microprocessor proceeds to step 194 and exits to the main control loop. When the space temperature is greater than setpoint, the microprocessor proceeds from step 196 to step 198 and adds one degree to the setpoint and proceeds to step 200 and subtracts space temperature from the thus adjusted setpoint. The microprocessor next inquires in a step 202 as to whether the difference calculated in step 200 is positive. As has been previously discussed with regard to step 182, in the event that the space temperature is one degree or more above setpoint, then the difference calculated in step 200 will be negative. A negative difference will prompt the microprocessor to proceed to a step 204 and set the "LAT Added Damper Positions" equal to zero. The zone control microprocessor will in this instance exit through step 194 to the main control loop. The main control loop will subsequently invoke the motor command program which will reposition the particular zone damper as a result of the cleared "LAT Added Damper Positions."

Referring again to step 202, in the event that a positive difference is detected, the zone control microprocessor will proceed to a step 206. As has been previously discussed with regard to steps 168 and 178, a positive difference indicates that space temperature is less than one degree higher than the zone setpoint. This positive difference is converted into incremental damper positions in a step 208. The conversion is preferably one damper position for every one tenth of a degree difference in temperature. The thus calculated damper positions become the new "LAT Added Damper Positions" value in step 208. The microprocessor proceeds from step 208 to exit back to the main loop control in step 194. The motor command program will subsequently be invoked and the new "LAT Added Damper Positions" value will be used to reposition the zone damper.

It is to be appreciated from the above that the check routine of FIG. 5C may update the zone control damper positioning anytime it is invoked during execution of the zone control software of FIGS. 5A and 5B. In all such instances, the check routine proceeds as has been previously described to possibly change the value of "LAT Added Damper Positions."

Referring to FIG. 1, it is to be understood that each zone control 30, 32 and 34 having its own respective zone control software can potentially make an adjustment to its damper positioning. This adjustment may occur in response to a communication from the master control 12 indicating that the supply air temperature in at least one zone is above the second stage trip temperature. This adjustment may also occur when each zone control merely invokes its check routine at appropriate times during execution of its zone control software. Each zone control will make its adjustments based upon a comparison of its local space temperature and its setpoint temperature. Incremental additions of one damper position at a time will occur if the space temperature is below setpoint. More than one damper position may be commanded if the local space temperature is above local setpoint by less than one degree. In this manner, each zone control will contribute as much as it can to the particularly detected supply air condition within the VAV system without unduly impacting the comfort level in any particular zone. This latter objective is of course accomplished by the corrective action being limited in any one zone control to a deviation of less than one degree from setpoint.

It is finally to be appreciated that a particular embodiment of the invention has been described. Alterations, modifications and improvements thereto will readily occur to those skilled in the art. Such alternation, modifications and improvements are intended to be part of this disclosure even though not expressly stated herein and are intended to be within the scope of the invention. Accordingly, the forgoing description is by way of example only and the invention is to be limited only by the following claims and equivalents thereto.

What is claimed is:

1. A system for controlling the positioning of dampers within a variable air volume system when the supply air temperature rises above a predefined temperature level, said system comprising:

a plurality of motors for positioning the dampers within the variable air volume system;

a plurality of sensors for sensing the temperature of the air supplied to each damper within the variable air volume system;

a plurality of programmable zone control units, each connected to a respective motor and to a sensor so as to normally control the positioning of the damper and further monitor the temperature of the air supplied to each damper that is sensed by the respective sensor;

a master programmable control unit connected to each programmable zone control unit said master programmable control unit having a stored program therein for successively reading the sensed temperatures of the air supplied to each damper from the programmable zone control units and for comparing the highest sensed temperature with a predetermined limit for sensed supply air temperature, said programmable master control unit being operative to send a warning to each of said programmable zone control units within the variable air volume system when the temperature of the air sensed by any sensor is higher than the predetermined limit of supply air temperature.

2. The system of claim 1 wherein each of said programmable zone control units has a program stored therein which comprises:

an instruction for comparing the temperatures of a space to be heated by the air supplied to a particular damper with a setpoint temperature for the space, and an instruction for increasing the presently commanded damper position by one additional incremental position upon receipt of the warning that supply air temperature is greater than the predetermined limit when the temperature within the space to be heated is below the setpoint temperature for the space.

3. The system of claim 2 wherein the program in each of said programmable zone control units further comprises:

a limit expressed in a predetermined number of added positions that the motor associated with the programmable zone control unit may successively move the damper in addition to a normally commanded position.

4. The system of claim 2 wherein the program in each of said programmable zone control units further comprises:

a set of instructions for periodically detecting whether a change in the warning has occurred from said programmable master control unit and for suspending the instruction for increasing the presently commanded damper position by one incremental position when a change in the warning is detected.

5. The system of claim 4 wherein the program in each of said programmable zone control units further comprises:

at least one instruction for checking whether the temperature of the space to be heated is greater than the setpoint temperature for the space when a change in the warning is detected;

at least one instruction for checking whether the temperature of the space to be heated is within a predefined amount of the setpoint temperature for the space when the temperature of the space is greater than the setpoint temperature for the space; and at least one instruction, responsive to a determination that the temperature of the space to be heated is within the predefined amount of the setpoint temperature, for calculating a number of additional incremental positions to be immediately commanded.

6. The system of claim 2 wherein the program within each of said programmable zone control units comprises:

at least one instruction, responsive to the temperature of the space to be heated being greater than the setpoint temperature for the space, for determining whether the temperature of the space to be heated is within a predefined amount of the setpoint temperature for the space; and at least one instruction, responsive to a determination that the temperature of the space to be heated is within the predefined amount of the setpoint temperature, for calculating a number of additional incremental positions to be immediately commanded.

7. The system of claim 6 wherein the program in each of said programmable zone control units further comprises:

at least one instruction, responsive to a determination that the temperature of the space to be heated is not within the predefined amount of the setpoint temperature, for deleting all previously added incremental damper positions.

8. The system of claim 1 wherein the program in said master programmable control unit comprises:

at least one instruction for reading the sensed temperatures of the air supplied to the dampers in a predefined order; and at least one instruction for defining a period of time which must elapse before again reading the sensed temperatures of the air supplied to the dampers in the predefined order.

9. The system of claim 8 wherein said instruction for reading the sensed temperatures in a predefined order comprises:

at least one instruction for addressing each programmable zone control unit;

at least one instruction for awaiting an identification from the programmable zone control unit; and at least one instruction for requesting the temperature of the air supplied to a damper upon receipt of an identification as to the programmable zone control units being a zone control within the variable air volume system.

10. The system of claim 1 wherein said program in said master control unit further comprises:

an instruction for terminating a stage of heating in the heating system supplying the air to each damper when the sensed temperature of the air supplied to at least one damper is greater than the predetermined limit of supply air temperature.

11. The system of claim 10 wherein said program in said master control unit further comprises:

an instruction for terminating an additional stage of heating in the air conditioning system supplying the air to each damper when the sensed temperature of the air supplied to at least one damper is greater than a still higher temperature than the predetermined limit of supply air temperature.

12. A process for controlling the positioning of dampers within a variable air volume system when the supply air temperature rises above a predefined temperature level, said system comprising the steps of:

controlling the positioning of dampers within the variable air volume system;

reading the respective temperatures of the air supplied to each damper;

determining the highest temperature from among the respective temperatures that have been read;

comparing the highest sensed temperature with a predetermined limit of supply air temperature; and warning controllers which position the dampers within the variable air volume system when the sensed temperature of the air supplied to at least one damper is higher than the predetermined limit of supply air temperature.

13. The process of claim 12 wherein said step of controlling the positioning of dampers within the variable air volume system comprises the steps of:

comparing the temperature of each space to be heated by a setpoint temperature for the space; and increasing the presently commanded damper position by one additional incremental position upon receipt of the warning that supply air temperature is greater than the predetermined limit when the temperature within the space to be heated is below the setpoint temperature for the space.

14. The process of claim 12 further comprising the step of:

limiting said step of increasing the presently commanded damper position to a predetermined number of added positions.

15. The process of claim 12 wherein said step of controlling the positioning of dampers within the variable air volume system further comprises:

detecting whether a change in the warning has occurred;

suspending said step of increasing the presently commanded damper position by one incremental position when a change in the warning is detected.

16. The process of claim 15 wherein said step of controlling the positioning of dampers within the variable air volume system further comprises:

checking whether the temperature of the space to be heated is greater than the setpoint temperature for the space when a change in the warning is detected;

checking whether the temperature of the space to be heated is within a predefined amount of the setpoint temperature for the space when the temperature of the space is greater than the setpoint temperature for the space; and calculating a number of additional incremental positions to be immediately commanded when the temperature of the space to be heated is within the predefined amount of the setpoint temperature.

17. The process of claim 13 wherein said step of controlling the positioning of dampers within the variable air volume system comprises the steps of:

determining whether the temperature of the space to be heated is within a predefined amount of the setpoint temperature for the space when the temperature of the space to be heated is greater than the setpoint temperature for the space; and calculating a number of additional incremental positions to be immediately commanded when the temperature of the space to be heated is within the predefined amount of the setpoint temperature.

18. The process of claim 17 wherein said step of controlling the positioning of dampers within the variable air supply system further comprises the step of:

deleting all previously added incremental damper positions when the temperature of the space to be heated is not within the predefined amount of the setpoint temperature.

19. The process of claim 12 wherein said step of reading the respective temperature of the air supplied to each damper comprises the steps of:

reading the respective temperatures of the air supplied to the dampers in a predefined order; and defining a period of time which must elapse before again reading the sensed temperatures of the air supplied to the dampers in the predefined order.

20. The process of claim 12 further comprising the step of:

terminating a stage of heating in a heating system supplying the air to each damper when the sensed temperature of the air supplied to at least one damper is greater than the predetermined limit of supply air temperature.

21. A system for responding to a change in temperature of the air being supplied to a plurality of individual zones to be heated, each zone having a controller for controlling the flow of heated air to the zone, said system comprising:

a master controller for determining the highest supply air temperature in any of the zones;

a communication link between said master controller and said zone controllers in each zone for sending a warning signal to each zone controller when the highest zone supply air temperature is greater than a predetermined limit of supply air temperature; and a program within each zone controller for adjusting the flow of air to the respective zone upon receipt of the warning signal.

22. The system of claim 21 wherein said program within each zone controller for adjusting the flow of air to the respective zone comprises:

a set of instructions for incrementally adjusting the flow of air by a specified amount every other time a warning signal is received by the zone controller when the space temperature in the zone to be heated is less than the setpoint temperature for the zone.

23. The system of claim 22 wherein said program within each zone controller for adjusting the flow of air to the respective zone further comprises:

at least one instruction for adjusting the flow of air by an amount calculated to cause the temperature of the zone to rise to predetermined amount above local setpoint when the temperature of the zone is less than the predetermined amount below setpoint.

24. A process for responding to a change in temperature of the air being supplied to a plurality of individual zones to be heated, each zone having a controller for controlling the flow of air to the zone, said system comprising the steps of:

determining the highest supply air temperature in any of the zones;

sending a warning to each zone controller when the highest zone supply air temperature is greater than a predetermined limit of supply air temperature; and adjusting within each controller the flow of air to the respective zone upon receipt of the warning.

25. The process of claim 24 wherein said means within said step within each zone controller of adjusting the flow of air to the respective zone comprises the step of:

incrementally adjusting the flow of air by a specified amount every other time a warning signal is received by the zone controller when the space temperature in the zone to be heated is less than the setpoint temperature for the zone.

26. The process of claim 25 wherein said step within each zone controller of adjusting the flow of air to the respective zone further comprises the step of:

adjusting the flow of air by an amount calculated to cause the temperature of the zone to rise to a predetermined amount above local setpoint when the temperature of the zone is less than the predetermined amount above setpoint.

* * * * *